United States Patent [19]

Durham

[11] 3,986,782

[45] Oct. 19, 1976

[54] TOWED ROLLER

[76] Inventor: Harvey E. Durham, Box 164, Manila, Ark. 72442

[22] Filed: Oct. 28, 1975

[21] Appl. No.: 626,008

[52] U.S. Cl. ..... 404/85; 404/129

[51] Int. Cl.[2] ..... E01C 19/00

[58] Field of Search ..... 404/122, 85, 86, 128, 404/129

[56] References Cited

UNITED STATES PATENTS

| | | | |
|---|---|---|---|
| 2,055,974 | 9/1936 | Greiner | 404/85 |
| 2,078,900 | 4/1937 | Biles | 404/85 |
| 2,171,255 | 8/1939 | Keeler | 404/85 |
| 2,348,445 | 5/1944 | Bayer | 404/85 |
| 2,386,025 | 10/1945 | Wills | 404/86 |
| 2,752,832 | 7/1956 | Fink | 404/85 |
| 2,830,511 | 4/1958 | Wills | 404/86 |
| 2,878,731 | 3/1959 | Kressin | 404/85 |
| 2,986,977 | 6/1961 | Swenson | 404/85 |
| 3,071,051 | 1/1963 | Martin | 404/128 |

*Primary Examiner*—Nile C. Byers, Jr.
*Attorney, Agent, or Firm*—Dowell & Dowell

[57] ABSTRACT

A towed roller for compacting asphalt, earth, etc., including a frame in which a roller drum is journaled, the frame having a forwardly extending drawbar positionable transversely with respect to the frame by hydraulic means to provide an offset in the towed position of the roller, and the frame carrying a transverse shaft which supports at its outer ends rearwardly-extending arms carrying ground-engaging transport wheels, the arms being positionable by hydraulic means to occupy a lowered transport position or to occupy a raised storage position, and drum sprinkler means coupled to be enabled or disabled automatically depending upon the position which the arms carrying the ground engaging wheels presently occupy.

4 Claims, 2 Drawing Figures

TOWED ROLLER

FIELD OF INVENTION

This invention relates to an improved roller or compactor of the type used to roll asphalt or other road materials, and more particularly relates to a roller to be towed behind a vehicle having an hydraulic system by which control cylinders on the roller can be actuated.

BACKGROUND AND PRIOR ART

The prior art includes many patents showing rollers of the present general type which are useful particularly for rolling small patches in a roadway and for rolling shoulder areas. These rollers are generally towed behind a truck or a tractor and have some means for raising the drum off of the ground to permit high speed transport of the roller to a new location along the roadway without damaging the latter during such transport. U.S. Pat. No. 2,986,977 to Swenson; U.S. Pat. No. 2,962,950 to Martin; U.S. Pat. No. 3,665,823 to Chaney; and U.S. Pat. No. 3,895,880 to Fink are of this type, the latter three patents including hydraulic cylinder means for raising the drum clear of the ground using the vehicle's hydraulic system, but at the expense of transferring the weight of the roller to the suspension and wheels of the vehicle.

U.S. Pat. No. 2,830,511 to Wills and U.S. Pat. No. 3,477,535 to Wyatt show rollers attached to a vehicle and lowerable by hydraulic means to raise one end of the vehicle from the ground, these disclosures using a second hydraulic cylinder to steer the roller when the vehicle is raised thereby. U.S. Pat. No. 2,386,025 to Wills is also of this same general type, but it includes means whereby the roll can be both steered and off-set from the center line of the towing vehicle to positions which can then be maintained by dropping a pin into a locating hole. U.S. Pat. No. 2,986,977 to Swenson and U.S. Pat. No. 3,071,051 to Martin show drum wetting devices from which the flow of water is controlled, the latter patent showing automatic means for turning on the water supply when the drum is in rolling position.

THE INVENTION

The improved roller according to the present invention comprises a frame having a roller drum mounted on an axle extending therethrough. The frame has a V-shaped extension located forwardly therefrom, and a drawbar is connected about a vertical pivot to the V-shaped extension so that it extends forwardly of the pivot to a towing vehicle and also extends rearwardly from the pivot to an arcuate plate fixed to the frame and having a series of locating holes therein. A pin can be dropped into one of the locating holes to fix the angle of the drawbar with respect to a longitudinal line drawn perpendicular to the axis of the rolling drum. An hydraulic cylinder arrangement is provided for positioning the drawbar to the desired angle before the pin is dropped into the locating hole to maintain that angle. A shaft extends transversely across the frame in front of the rolling drum and is journaled in the frame. A second hydraulic cylinder is connected to actuate a crank arm depending from the center of the shaft so as to rotate the shaft when the second hydraulic cylinder moves back and forth. The ends of the shaft extend transversely beyond the frame and carry arms whose outer ends support ground engaging wheels journaled on stub axles. Thus, rocking of the crank arm by moving the second cylinder rotates the shaft and moves the wheels up and down to raise the roller drum off of the ground for transport on the rubber tire wheels, or alternatively to lower the drum into the rolling position wherein the wheels are raised. An arrangement is provided for securely locking the shaft in one of two definite positions so as to fix the position of the ground engaging wheels without requiring the hydraulic cylinder to be pressurized in either direction. Above the drum is a water tank which is pivotally mounted on extensions of the frame. A linkage connects the water tank and the wheelcarrying arms and is designed so that when the wheels are down and supporting the roller drum off of the ground, the tank is rotated to a disabled position which keeps the water from sprinkling out of it. On the other hand, when the shaft is rotated so that the ground engaging wheels are up and the roller drum is in contact with the ground, the water tank is rotated to an operative position in which the water can drip from the tank onto the surface of the roller drum. The hydraulic control lines for both cylinders extend forwardly along the drawbar and connect to the hydraulic system of the towing vehicle.

It is the principle object of this invention to provide an improved roller adapted to be towed behind a vehicle and to use the hydraulic system of the vehicle to control the lateral offset of the roller from the longitudinal center of travel of the vehicle, and to control the position of the rubber tires of the ground engaging wheels so as to raise or lower the drum with respect to the roadway.

Another object of the invention is to provide a roller assembly of the type specified in which no modification of the truck which tows it is required, other than to connect the hydraulic lines to the truck and to provide a towing hitch attached to the frame of the truck, the drawbar offset means being contained entirely within the roller itself.

A further object of the invention is to provide improved means for locking the ground engaging wheels either in up position or in down position so that pressure in the cylinder is not continuously required to maintain selected positions of the wheels.

Another object of the invention is to provide means for positively locking the drawbar in one of a number of selected positions so that pressure is not continuously required in the cylinder controlling the offset of the drawbar in order to maintain a selected position.

Still a further object of the invention is to provide a roller wherein the axles of the ground engaging wheels are in approximate vertical alignment with the axis of the main roller drum when the wheels are in down position, whereby very little load is transferred to the towing vehicle when the rolling drum is raised from the highway, thereby not significantly increasing the load on the suspension of the towing vehicle.

It is a further object of the invention to provide a novel water sprinkler system for wetting the drum when the latter is rolling asphalt or other sticky materials, the roller including a tank rotatably mounted above the drum and having a sprinkler pipe mounted parallel to the tank and passing along the length of the tank transversely across the face of the roller drum, and the water tank being rotatable from a disabled position in which the sprinkler pipe is raised above the tank to an operative position in which the sprinkler pipe is located beneath the tank and adjacent to the roller drum, these two positions being respectively achieved by linkages which are responsive to the position of the wheel supporting arms which alternatively place the transport wheels into drum elevating position or into the useful position of the drum in which the latter engages the ground and the wheels are raised clear of the ground.

Other objects and advantages of the invention will become apparent during the following discussion of the drawing, wherein:

THE DRAWINGS

Figures 1, 2:
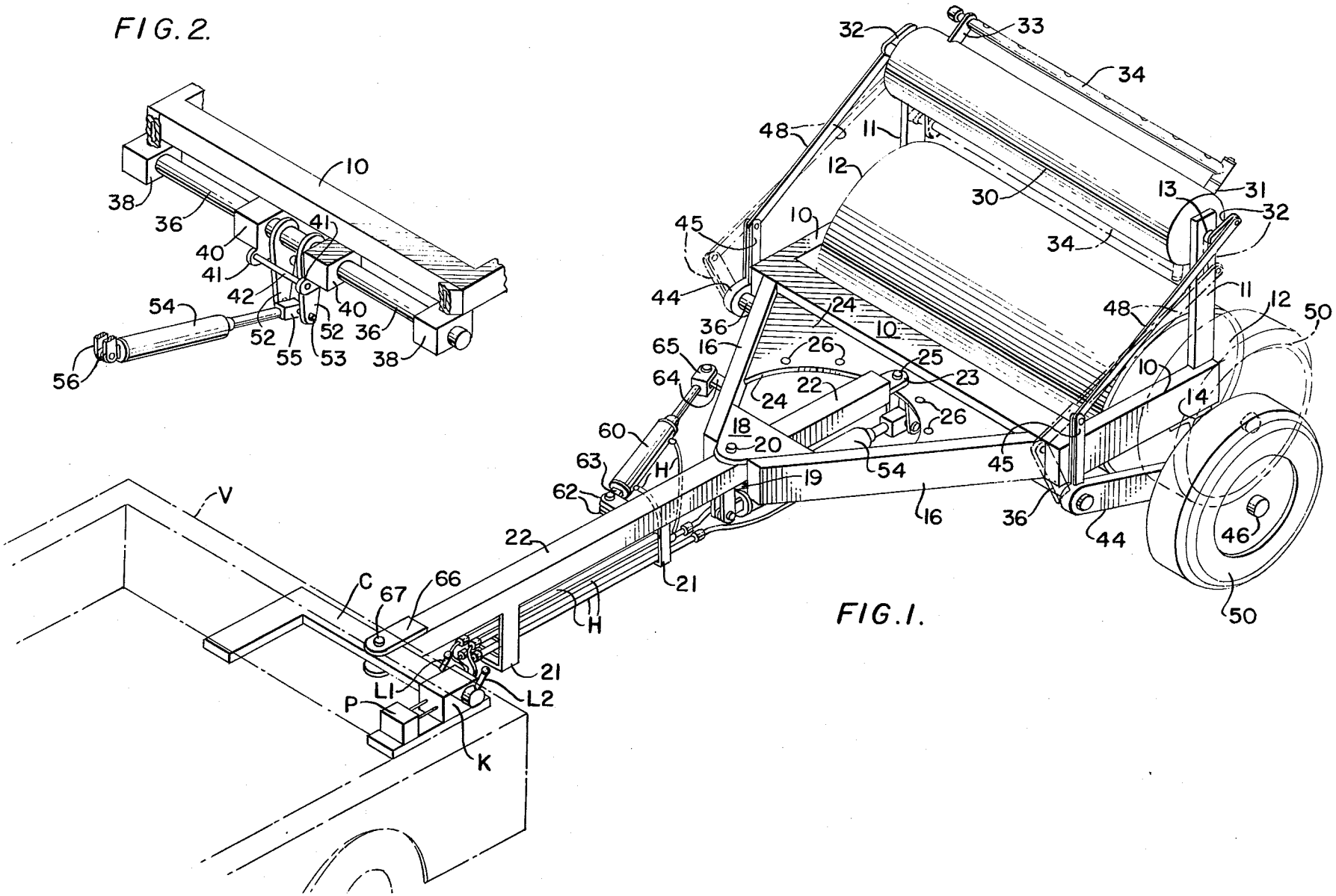
FIG. 1 is a perspective view of a roller according to the present invention coupled to the rear end of a towing vehicle which includes an hydraulic system to which the roller is connected.
FIG. 2 is a detailed view showing a portion of the mechanism of FIG. 1.

Referring now to FIG. 1, the roller comprises a heavy frame 10 which is shaped to surround a roller drum 12 which is journaled in the frame, for instance using a journal block 14 beneath the frame on each side, although the axle of the drum can be extended through the frame itself as an alternative construction. The frame has a forwardly extending triangular portion 16 converging upon a pivot plate 18 which is welded to the two portions 16. The pivot plate has a pin 20 extending downwardly through it, and through a similar pivot plate 19 therebelow, and a drawbar 22 extends between the pivot plates 18 and 19 and is coupled thereto by the pin 20. Thus, the drawbar can pivot about the pin 20 in the horizontal plane. The frame supports an arcuate locating plate 24 which is welded to the portion 16 and to the transverse portion of the frame 10 and has a series of locating holes 26 spaced around the arc of the plate 24 which extends forwardly. The drawbar 22 has a lug 23 extending rearwardly therefrom with a hole though the lug positioned to align with one of the holes 26 in the locating plate 24 as the drawbar 22 is pivoted back and forth around the pin 20.

The frame 10 also includes two upward extensions 11 having bearing holes 13 near their top ends with trunnions extending through the holes 13 and fixed to the ends of a circular water tank 30. Each of the trunnions has a crank arm 32 connected therewith the purpose of which will be described hereinafter. The water tank has a pipe 31 extending therefrom to a sprinkler pipe 34 which extends parallel across the length of the water tank 30 and has a series of sprinkler holes therein. The other end of the sprinkler pipe is supported on a bracket 33 welded to the tank. The pipes 31 and 34 are loated with respect to the crank arms 32 such that in one position of the cranks, as shown in solid lines in FIG. 1, the water sprinkler pipe 34 will be raised above the level of the tank so that no sprinkling will occur, and in the other position of the cranks 32, as shown in dashed lines, the sprinkler pipe 34 will be beneath the water tank 30 and will therefore be sprinkling water at spaced intervals onto the top surface of the rolling drum 12, as will be described hereinafter.

A shaft 36 extends transversely across the frame 10 therebelow and parallel to the rolling axis of the drum 12. The shaft 36 is supported at its outer ends in bearing blocks 38 which are welded to the bottom of the frame 10. There are also two bearing blocks 40 located near the center of the shaft as can be seen best in FIG. 2. The bearing blocks 40 support shackle lugs 41 having holes therethrough which receive a pin 42 for the purpose hereinafter discussed.

At each of the outer ends of the shaft 36 there is fixed an arm 44, the arms respectively supporting stub axles 46 carrying ground engaging wheels 50. In addition, each arm carries an upwardly extending lever 45 which is pivotally connected with one end of a rod 48, the other end of which is pivotally connected to the outer end of one crank 32.

Near the center of the shaft 36, as can be seen best in FIG. 2, there is mounted a pair of downwardly extending cranks 52 which are welded at their upper ends to the shaft 36 and which carry a transverse pin 53 at their lower ends. The outer end 55 of the piston rod of an hydraulic cylinder 54 is coupled by the pin 53 to the crank arms 52, whereas the other end of the cylinder 54 is connected to a pair of depending arms 56 which extend downwardly from the lower plate 19 at the front of the V-shaped extension 16 of the frame 10. Thus, it can be seen that when the pin 42 is removed from the shackle lugs 41, the cylinder 54 which is double-acting, can be pressurized in different directions to either retract the crank arms 52 forwardly and thereby lower the ground engaging wheels 50, or alternatively to extend the cylinder so as to push the crank arms 52 rearwardly and thereby raise the ground engaging wheels 50. As this is done, the water tank 30 is rotated between the illustrated position in which it is inoperative, and an operative position where the tank 30 and sprinkler pipe 34 are substantially inverted to place the pipe 34 below the tank 30 where it drips water onto the surface of the rolling drum.

Another hydraulic cylinder 60 is suppoted at its forward end on outwardly extending lugs 62 welded to the side of the drawbar 22, and has a piston member which is supported at its rearward end on a lug 64 welded to the forward extension member 16 of the frame. At each of these joints a pin provides the pivot in the coupling, for instance between the lugs 62 and the lugs 63 on the rear end of the cylinder 60, and between the lugs 64 and a coupling member 65 on the end of the piston rod of the cylinder 60. When the offset of the drawbar 22 is to be changed, the pin 25 is removed from the locating plate 24 and the lug 23 at the rearward end of the drawbar 22, and then the cylinder 60 is actuated selectively in one direction or the other to pivot the drawbar 22 in the horizontal plane about the vertical pin 20. This may require considerable effort in view of the fact that the forward end of the drawbar has a coupling 66 connected with a chassis member C of the towing vehicle, using a pin 67. Thus, when the roller is coupled to a vehicle the pivoting of the drawbar about the pin 20 by the cylinder requires moving the main body of the roller, and this may require a considerable amount of effort since the resistance to articulation of the frame 10 with respect to the drawbar 22 can be great if the roller 12 is in contact with the ground, or if the ground engaging wheels 50 are in contact with the ground where the surface contour of the ground opposes articulation about the pin 20.

The fluid system of the vehicle V supplies either hydraulic or pneumatic pressure from a vehicle-mounted pressure pump P to a control box K having a pair of control levers L1 and L2 for respectively controlling the flow of fluid pressure to the cylinder 60 and to the cylinder 54. As is well known in this type of control, when either of the levers L is in neutral position, the cylinder associated with that lever holds its position, but whenever the lever is moved in one direction the cylinder is extended one way, and whenever the lever is moved in the opposite direction from the centered position the cylinder is moved oppositely. Flexible fluid hoses H extend forwardly from the cylinders and connect to conduits in supporting brackets 21 which are welded to the drawbar, appropriate lengths of pressure tubing being used at the forward ends of the conduits for flexibility in a manner well known per se.

This invention is not to be limited to the exact form shown in the drawings, for obviously changes can be made within the scope of the following claims.

I claim:

1. A compaction roller to be towed behind a vehicle having a source of fluid pressure and controls for determining the direction of flow of said fluid through conduits coupled to the outputs of said controls, the roller comprising:

a frame having rearwardly extending mutually spaced side members, and having converging forward extension members joined at their forward ends to pivot supporting frame members;

a roller drum journaled transversely between said side members;

a drawbar having a forward end to be coupled to said vehicle and having a rearward end, the drawbar being connected intermediate its ends to said pivot members by vertically disposed pivot means about which the drawbar can pivot in a horizontal plane;

a locating plate fixed to said frame and having an arcuate portion registering with an arc through which the rearward end of the drawbar can pivot;

means engageable to lock said rearward end to said pivot plate in one of multiple selectable positions;

a shaft journaled across said frame;

an arm fixed to each end of the shaft and disposed in a plane parallel to said side members and having ground wheels carried by the arms;

first fluid actuated power means coupled to rotate said shaft and connected to said conduits and operative selectively to raise the ground wheels above the ground and to force the ground wheels down against the ground and elevate the frame to raise the drum therefrom;

second fluid-actuated power means coupled to said conduits and operative selectively to change the angle of the drawbar with respect to said frame when said lock means is disengaged;

upward extensions of the frame fixed to each side member adjacent the roller drum and extending thereabove;

a water tank supported on journals in said upward extensions, the tank having an axis disposed parallel to the axis of the roller drum and located thereabove and being rotatable about said axis, and the tank having sprinkling means attached to one side of the tank and disposed to sprinkle water onto the drum when the tank is rotated to an operative position but to be raised above the tank when the tank is rotated to inoperative position; and linkage means actuated by rotation of said shaft to cause rotation of said tank such that the tank is rotated to operative position when the shaft is rotated to raise the wheels above the ground, and the tank is rotated to inoperative position when the shaft is rotated to force the wheels down against the ground.

2. In a compaction roller as set forth in claim 1, said sprinkling means comprising a perforated pipe extending parallel to the side of the tank and connected thereto, the pipe being positioned above the tank when the tank is in inoperative position and the wheels are raised.

3. In a compaction roller as set forth in claim 1, lever means extending radially from said shaft; crank means extending radially from said tank journals, and said linkage means connecting said crank means with said lever means.

4. In a compaction roller as set forth in claim 1, said frame having a transverse frame member extending parallel to said shaft and joining the side members and the converging members where they intersect, the shaft being journaled in said transverse member, and said locating plate having a rear edge fitting against and secured to said transverse member and having diagonal side edges fitting against and secured to said converging members, and the arcuate portion of the plate facing forwardly.

* * * * *